US007050009B2

(12) United States Patent
Chirila

(10) Patent No.: US 7,050,009 B2
(45) Date of Patent: May 23, 2006

(54) INTERNAL ANTENNA

(75) Inventor: Laurian P. Chirila, Waterdown (CA)

(73) Assignee: Psion Teklogix Inc., Mississauga (CA)

( * ) Notice: Subject to any disclaimer, the term of this patent is extended or adjusted under 35 U.S.C. 154(b) by 0 days.

(21) Appl. No.: 10/895,899

(22) Filed: Jul. 22, 2004

(65) Prior Publication Data

US 2005/0040992 A1 Feb. 24, 2005

Related U.S. Application Data

(60) Provisional application No. 60/488,796, filed on Jul. 22, 2003.

(51) Int. Cl.
*H01Q 1/24* (2006.01)
*H01Q 1/38* (2006.01)

(52) U.S. Cl. ..... 343/702; 343/700 MS; 343/846

(58) Field of Classification Search ..... 343/700 MS, 343/702, 846, 770
See application file for complete search history.

(56) References Cited

U.S. PATENT DOCUMENTS 5,262,792 A 11/1993 Egashira ..... 343/702
6,133,879 A * 10/2000 Grangeat et al. .... 343/700 MS
6,392,609 B1 * 5/2002 Nieminen ..... 343/767
6,806,834 B1 * 10/2004 Yoon ..... 343/702
6,930,642 B1 * 8/2005 Kossiavas et al. ..... 343/702
2002/0008664 A1 1/2002 Hang-Ku et al. ..... 343/700
2002/0021251 A1 2/2002 Royden ..... 343/702
2004/0027292 A1 * 2/2004 Gabriel et al. ..... 343/700 MS

FOREIGN PATENT DOCUMENTS

| | | |
|---|---|---|
| EP | 0 892 459 | 1/1999 |
| WO | WO 01/89031 | 11/2001 |
| WO | WO 02/50940 | 6/2002 |
| WO | WO 02/103843 | 12/2002 |

* cited by examiner

*Primary Examiner*—HoangAnh Le
*Assistant Examiner*—Tung Le

(74) *Attorney, Agent, or Firm*—Blake, Cassels & Graydon; John R. S. Orange; Sean X. Zhang

(57) ABSTRACT

An antenna includes a substrate having a pair of oppositely directed surfaces. A source plane conductor is located on one of the surfaces and has a signal line connected thereto. A ground plane conductor is located on another of the surfaces. Each of the conductors has a slot extending therethrough with the slots sized and positioned relative to one another to inhibit the intensity of radiation emanating from the ground plane.

11 Claims, 8 Drawing Sheets

INTERNAL ANTENNA

This application claims priority from U.S. Provisional Pat. application No. 60/488,796 filed on Jul. 22, 2003.

FIELD OF THE INVENTION

The present invention relates to antennas for wireless communications.

BACKGROUND OF THE INVENTION

Portable devices having wireless communications capabilities are currently available in several different forms, including mobile telephones, personal digital assistants and hand held scanners.

The demand for wireless connectivity from portable devices is rapidly expanding. As a result, the demand for high performance, low cost, and cosmetically appealing antenna systems for such devices is also increasing.

One type of antenna commonly used in portable wireless devices is the monopole whip. A monopole whip antenna is essentially a wire that extends along or away from the device and is fed by the printed circuit board (PCB) of the device. One problem of this unbalanced design is that radio frequencies (RF) currents induced on the PCB may cause receiver desensitization, thereby limiting the useful range of the device.

In a monopole whip design as described above, and other unbalanced designs used in similar applications, the PCB may function as a part of the antenna. As a result, the PCB may also radiate a portion of a signal being transmitted, causing operating characteristics of the antenna such as gain, radiation pattern, and driving point impedance to become dependent on qualities of the PCB such as size, shape, and proximity to other structures (such as a display, a cable, a battery pack, etc.). Therefore, it may become necessary to redesign the antenna to achieve a similar performance with different applications and/or different types of devices.

Radiation by a PCB due to RF coupling with an unbalanced antenna may also cause efficiency losses. In a mobile phone application, for example, radiation of a PCB that is placed next to the user's head may be wasted due to absorption of the radiating fields by the user's head and hand. In addition to reducing the efficiency of the device, this effect may also increase the specific absorption rate (SAR) beyond regulatory limits.

A coaxial sleeve dipole is a balanced antenna that tends to de-couple the antenna system from the PCB or device to which it is connected. Such an antenna is constructed of coaxial cable, where the center conductor extends beyond the outer conductor, and the outer conductor is rolled back to form a jacket. One advantage of this design is that if the jacket has the right length, then current which otherwise might distort the radiation pattern may be impeded from flowing along the outer surface of the feed cable. Unfortunately, coaxial sleeve dipoles are too bulky and heavy to be practical for use in small portable devices and are not compatible with the small, slim profiles of present portable wireless devices. Additionally, coaxial sleeve dipoles are relatively expensive.

Accordingly, it is an object of the present application to obviate or mitigate the above disadvantages.

SUMMARY OF THE INVENTION

In one aspect, the present invention provides an antenna comprising a substrate having a pair of oppositely directed surfaces. A source plane conductor is located on one of the surfaces having a signal line connected thereto. A ground plane conductor is located on another of the surfaces. Each of the conductors has a slot extending therethrough with the slots sized and positioned relative to one another to inhibit the intensity of radiation emanating from said ground plane. Preferably each of said slots extend from a peripheral edge of said substrate. Preferably also one of said slots is L shaped.

An embodiment of the invention will now be described by way of example only with reference to the following detailed description in which reference is made to the following appended drawings, in which:

DETAILED DESCRIPTION OF THE INVENTION

Figure 1:
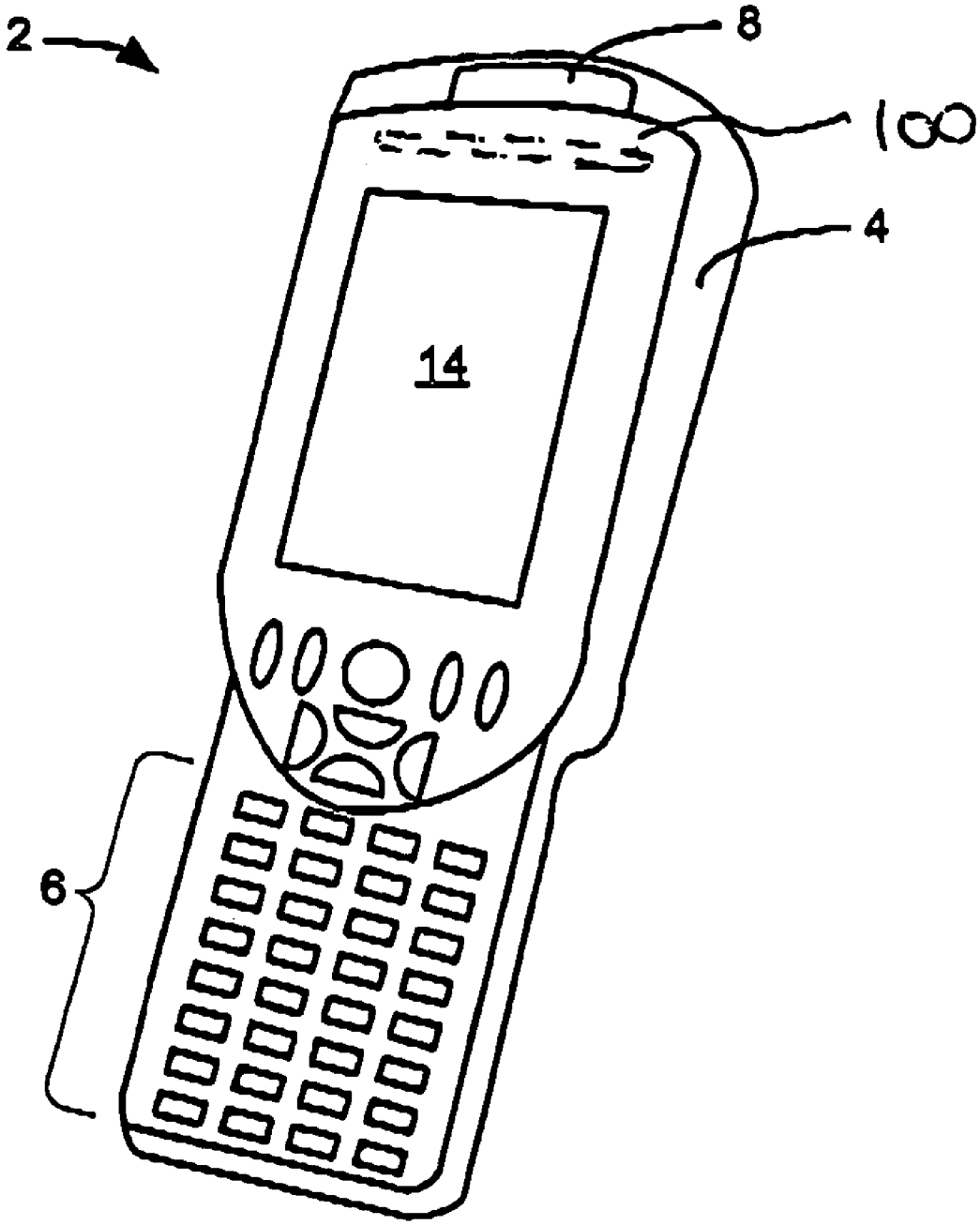
FIG. 1 is a perspective view of a hand held scanner.

Referring to FIG. 1, there is shown a hand held scanner 2 having a body 4 and a display 14. The scanner may include an input device, such as keypad 6, and is used to read and store information from barcodes or the like through a scanner window 8. The body 4 contains control and data acquisition components as well as a communication module and an internal antenna 100. The scanner 2 maybe used in a variety of locations in which transfer of data to a central database is desirable.

Figure 2:
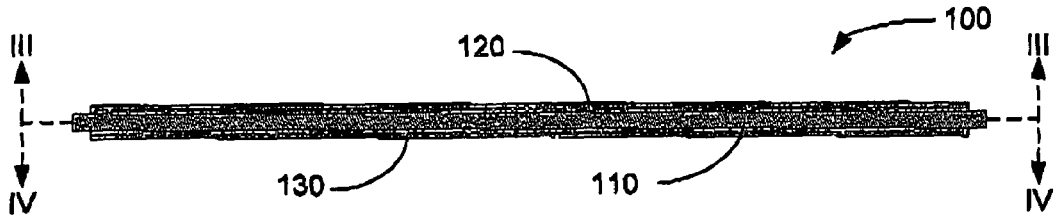
FIG. 2 shows a cross-sectional view of an antenna utilized in the scanner of FIG. 1.
Figure 3A:
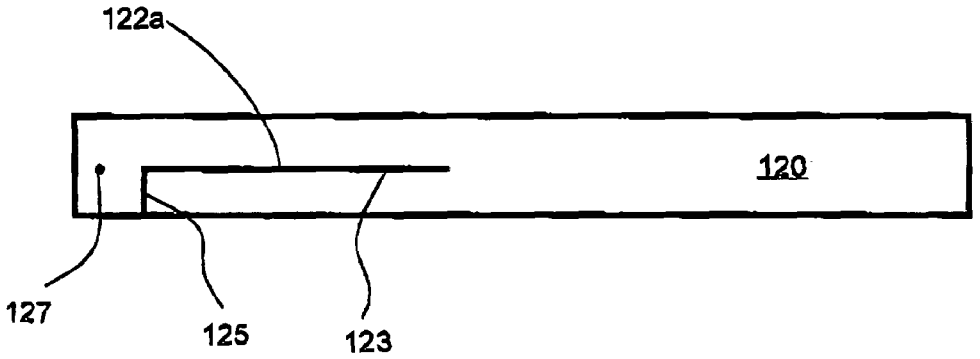
FIG. 3A shows a top view (along axis III—III as shown in FIG. 2) of an antenna utilized in the scanner of FIG. 1.
Figure 4A:
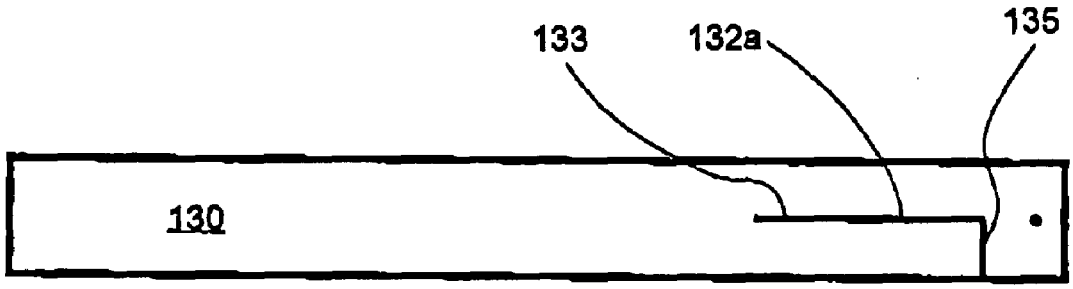
FIG. 4A shows a bottom view (along axis IV—IV as shown in FIG. 2) of the antenna shown in FIG. 3A.

Referring therefore to FIGS. 2, 3A and 4A, the antenna 100 comprises a substrate 110 having two oppositely directed conductive planes 120 and 130. The plane 120 may be referred to as the source plane 120 while the bottom plane 130 may be referred to as the ground plane 130. Slots 122 and 132 are formed in the planes 120, 130 respectively. In a particular embodiment, the substrate 110 may be, for example, the substrate portion of a printed circuit board (PCB). The conductive planes 120, 130 are created by covering the substrate 110, through lamination, roller-cladding or any other such process, with a layer of a conductive material, for example copper. Source slot 122 and ground 132 slot are created by etching, or otherwise removing, conductive material from the conductive planes 120, 130 respectively. Each of the slots 120, 130 is L shaped with one leg 123, 133, extending parallel to the longitudinal axis of the antenna and the other leg 125, 135, extending normal or transverse to the axis to the periphery of the antenna. The axial legs and transverse legs are juxtaposed on each plane so that the legs are aligned with one another. A signal line (not shown) is connected to the source plane 120 at hole 127, and the ground plane 130 connected to ground, either by a cable shield or through a mechanical connector with the body 4.

Alternatively, substrate 110 may be another non-conductive material such as a silicon wafer or a rigid or flexible plastic material. The substrate 110 may also be formed into a non-flat shape e.g., curved, so has to fit into a specific space within, for example, a scanner body 4.

Certain desirable properties such as increased efficiency may be obtained by using a material for substrate 110 that has specific properties, such as a particular permittivity or dielectric constant, at the desired frequency or frequency range of operation. For example, at higher frequencies, such as a frequency of 5 GHz, a higher dielectric constant may be desirable. Preferably, the material used for substrate 110 has uniform thickness and properties.

In a typical configuration, for the source slot the leg 125 is 0.160 mill and the axial leg 123 is 0.920 mill. The ground slot has a transverse leg 135 of 0.160 mill and an axial leg of 0.580 mill. The axial length of the antenna 100 is 2670 mill and the width 320 mill. The width of the slot is 20 mill.

Figure 3B:
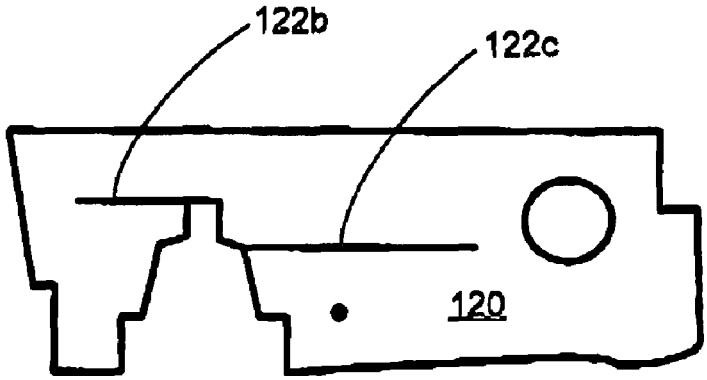
FIG. 3B shows a top view (along axis III—III as shown in FIG. 2) of an alternative antenna utilized in the scanner of FIG. 1.

It may be desirable to design the contours of the antenna 100 substrate 110 to fit into the available space in a device. FIG. 3B and 4B show the top and bottom views respectively of an antenna 100 according to an alternative embodiment of the invention having a substrate 110 that is designed to fit into an irregularly shaped space with a recess 112 to fit around a connector. As will be seen, the source slot 122 is divided into a pair of slots 122*b*, 122*c*, extending to either side of the recess 112. The ground slot is L shaped as with embodiment 3B for the source slot. The leg 132*b* is aligned with the leg 122*c* on the source plane. In a typical embodiment for an antenna with overall dimensions of 1954×710 mill. The leg 122*b* has a length of 325 mill and 122*c* has a length of 660 mill. On the ground plane the length of transverse leg is 379 mill and the axial leg has a length of 270 mill. In a further embodiment shown in FIGS. 3C and 4C, the source slot 122 is formed as an H-pattern having an axial bar 122*d* terminating in a pair of transverse legs 122*e*. The bar 122*d* is connected to a intermediate leg 122*f* extending from the bar 122*d* to the periphery. The leg 122*f* is aligned with the transverse leg of slot 132*c* and the axial leg of slot 132*c* aligned with the bar 122*d*. In a typical configuration, the axial length of the bar 122*d* is 1400 mill and each of the transverse legs 415 mill. The intermediate leg is 370 mill and is offset to be 600 mill from one of the legs 122*e*. The ground slot is L shaped with a vertical leg of 0.370 mill and a horizontal leg of 0.370 mill. Again, the width of the slot is 0.020 mill. The overall dimensions of the antenna 100 is 1960×688 mill.

Figure 3C:
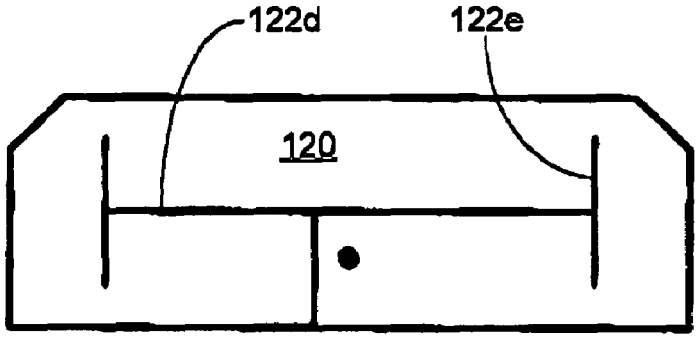
FIG. 3C shows a top view (along axis III—III as shown in FIG. 2) of an alternative antenna utilized in the scanner of FIG. 1.
Figure 4B:
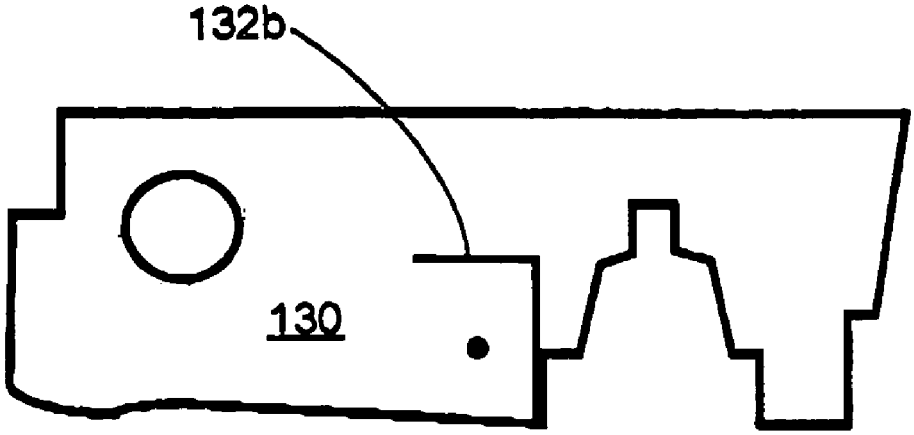
FIG. 4B shows a bottom view (along axis IV—IV as shown in FIG. 2) of the antenna shown in FIG. 3B.
Figure 4C:
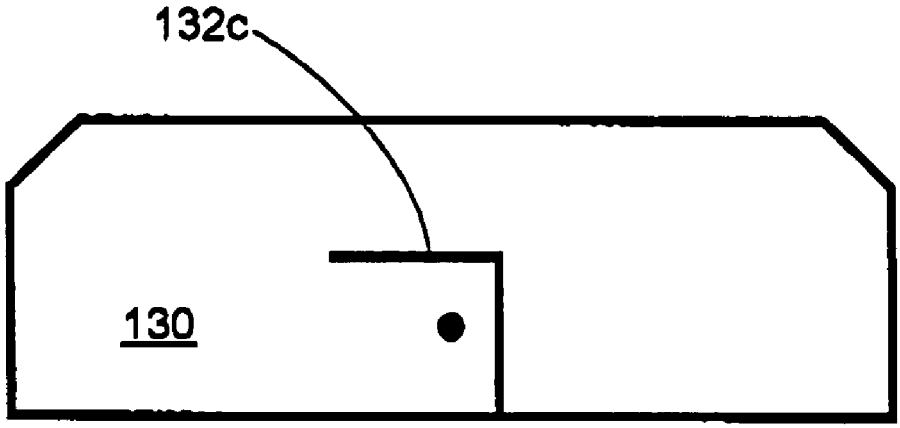
FIG. 4C shows a bottom view (along axis IV—IV as shown in FIG. 2) of the antenna shown in FIG. 3C.
Figure 5:
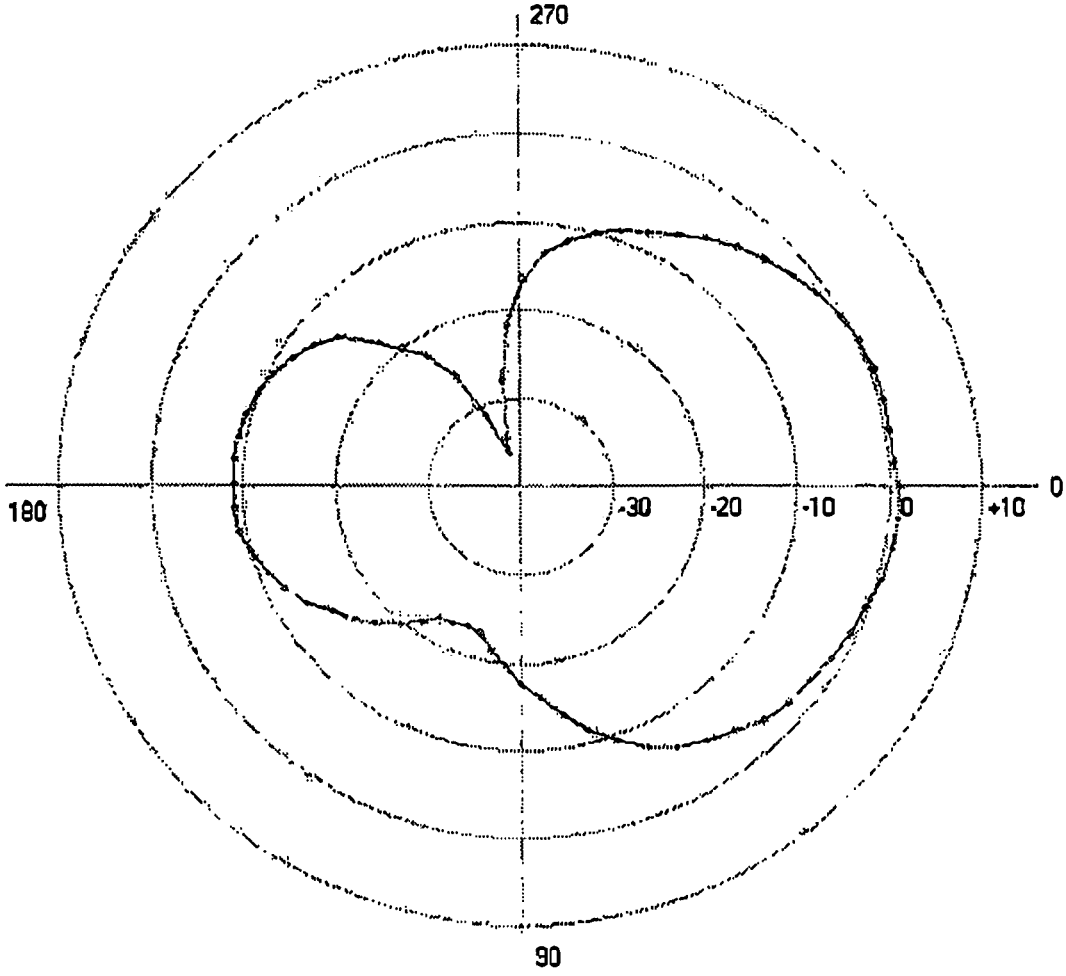
FIG. 5 shows a graph of the radiation pattern for the antenna illustrated by FIGS. 2, 3A, 4A, 3B, 4B and 3C, 4C.

An antenna 100 described by either FIGS. 2, 3A and 4A, FIGS. 2, 3B and 4B or FIGS. 2, 3C and 4C exhibits a radiation pattern that tends to be directional, as illustrated by FIG. 5, which shows a graph of the radiation pattern for such an antenna 100. It may be observed that the radiation pattern of such an antenna 100 tends to be null along the axis of the antenna 100 and of reduced power when emanating from the ground plane 130 when compared to the source plane 120. Therefore, it may be desirable to configure a particular application of such an antenna 100 according to an appropriate orientation with respect to a receiver to which the antenna is expected to radiate (or, a transmitter from which the antenna is expected to receive a signal).

The use of such an antenna 100 may reduce or avoid blockage of the radiated signal by, for example, the user's head or hand, in an application such as a cellular telephone, a PDA, a handheld scanner 2 or any other handheld wireless device. A possible benefit is the reduction in measured specific absorption rate (SAR), which is related to the heating of body tissues caused by the radio waves outputted by the wireless device. Another possible benefit is that the ground plane 130 also serves to reduce or block high frequency noise generated by processors used within the wireless device, which clock frequencies may fall within the frequency band of the antenna.

The relative positioning and sizing of the slots on the source plane and ground plane may be adjusted so as to enhance the radiation intensity in the forward direction and reduce the radiation intensity in the rear direction. This may be accomplished by considering the relative phases of the radiation component from each plane. Similarly, the spacing between the planes may be adjusted to optimize the interaction of the radiation from each plane to attain the desired radiation pattern.

Figure 6:
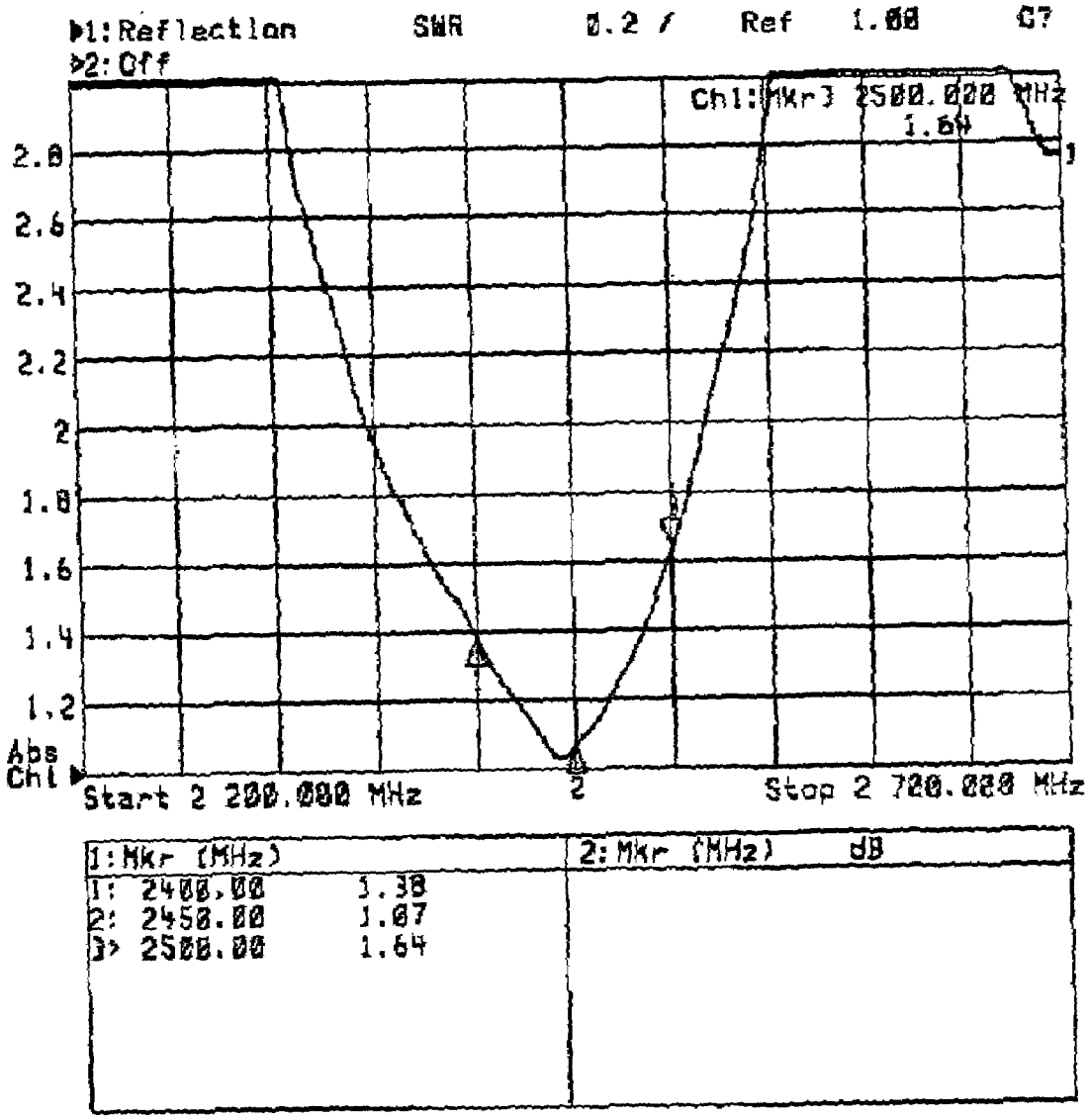
FIG. 6 shows a Voltage Standing Wave Ratio (VSWR) graph for the antenna illustrated by FIGS. 2, 3A and 4A.
Figure 7:
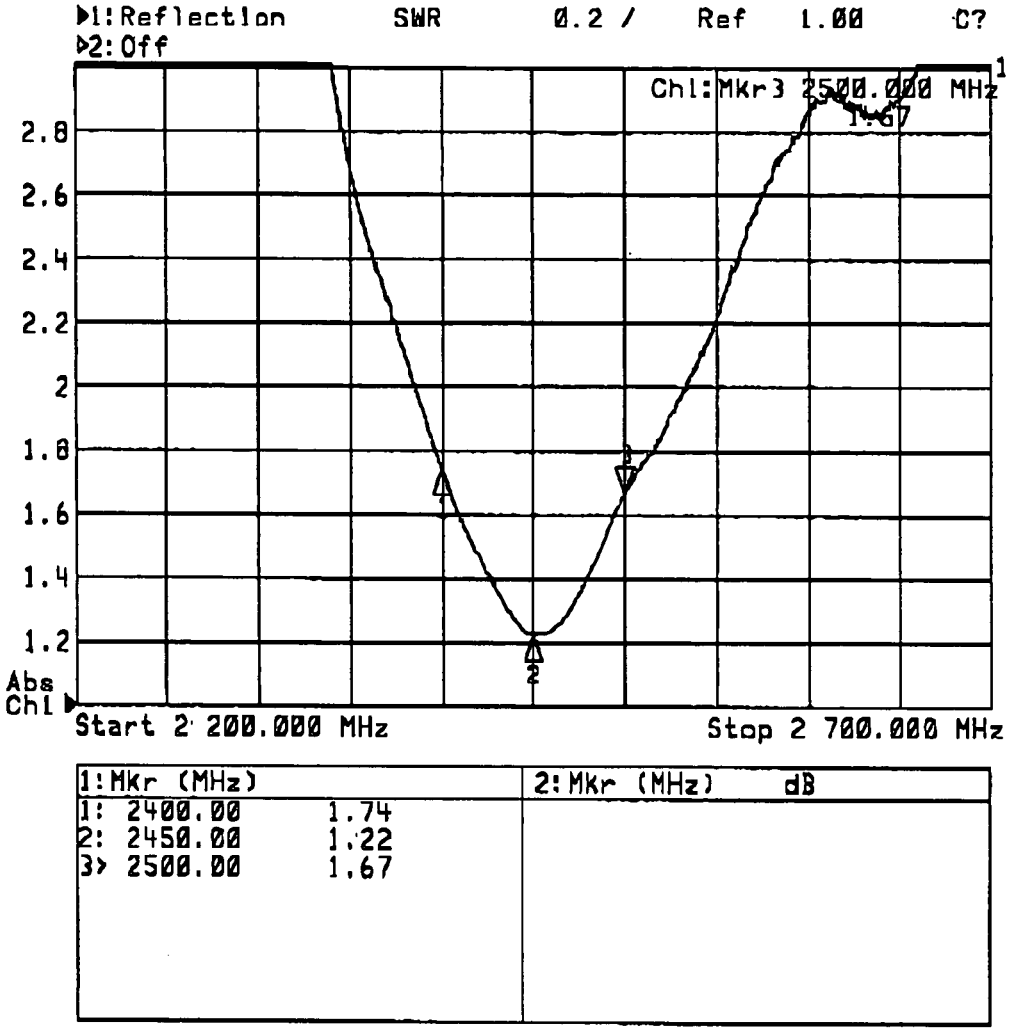
FIG. 7 shows a Voltage Standing Wave Ratio (VSWR) graph for the antenna illustrated by FIGS. 2, 3B and 4B.
Figure 8:
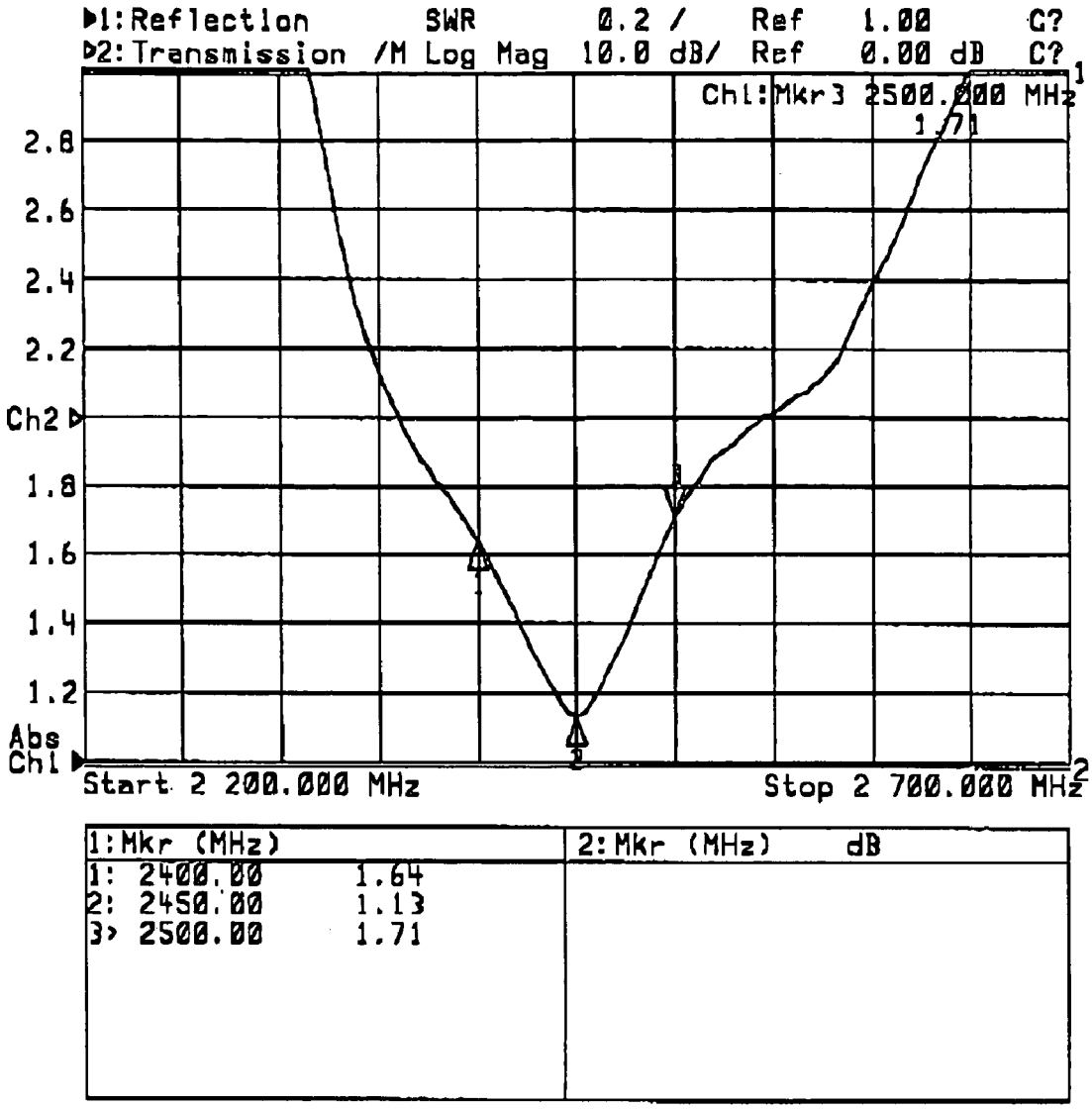
FIG. 8 shows a Voltage Standing Wave Ratio (VSWR) graph for the antenna illustrated by FIGS. 2, 3C and 4C.

As know by a person skilled in the art, the voltage standing wave ratio (VSWR) is used as a performance parameter to quantify the percentage of power that will be reflected at the input of the antenna. When VSWR is evaluted, a value closer to 1.00:1 is more desirable than one that is higher. A VSWR of 3.00:1 is considered the maximum acceptable and results in a 25% reduction of power or 1.2 dB loss. FIGS. 6, 7 and 8 show the VSWR graphs for the antennas 100 described by FIGS. 2, 3A, 4A, FIGS. 2, 3B, 4B and FIGS. 2, 3C, 4C respectively and show band edges (2.40 GHz and 2.50 GHz) having VSWR values between 1.38:1 and 1.74:1 and a center frequency (2.45 GHz) VSWR value between 1.07:1 to 1.22:1, including cable and connector loss.

Tables 1, 2 and 3 show the effect of the variation in the length of the source slot (S) 122 and the ground slot (G) 132 on the VSWR and bandwidth (BW) values for an application having a center frequency of 2.45 GHz and band edges of 2.40 GHz and 2.50 GHz, such as in the ISM standard, for the antennas 100 described by FIGS. 2, 3A, 4A, FIGS. 2, 3B, 4B and FIGS. 2, 3C, 4C respectively. The lengths of slot S 122 and slot G 132 are expressed in mils (e.g. $1/1000^{th}$ of an inch) and represent the total length of the slot including each of the legs in the configurations of FIGS. 3A, 4A, and 3B, 4B. The lengths S and G include axial bar 122*d* and transverse legs 122*e* for the embodiment of FIG. 3C.

TABLE 1

FIGS. 2, 3A and 4A

| S | G | VSWR 2.40 GHz | VSWR 2.45 GHz | VSWR 2.50 GHz | VSWR Average | BW VSWR = 2.5 |
|---|---|---|---|---|---|---|
| 1040 | 760 | 1.67 | 2.31 | 2.6 | 2.19 | 260 |
| 1050 | 760 | 1.79 | 2.25 | 2.4 | 2.15 | 320 |
| 1060 | 760 | 1.51 | 2.06 | 2.28 | 1.95 | 330 |
| 1070 | 760 | 1.41 | 1.76 | 2 | 1.72 | 340 |
| 1080 | 760 | 1.21 | 1.6 | 2.05 | 1.62 | 350 |

TABLE 1-continued

| FIGS. 2, 3A and 4A | | | | | | |
|---|---|---|---|---|---|---|
| S | G | VSWR 2.40 GHz | VSWR 2.45 GHz | VSWR 2.50 GHz | VSWR Average | BW VSWR = 2.5 |
| 1060 | 740 | 1.35 | 1.56 | 2.06 | 1.66 | 325 |
| 1060 | 750 | 1.42 | 1.38 | 1.76 | 1.52 | 320 |
| 1060 | 760 | 1.51 | 2.06 | 2.28 | 1.95 | 330 |
| 1060 | 770 | 1.52 | 2.22 | 2.77 | 2.17 | 265 |
| 1060 | 780 | 1.82 | 2.82 | 2.97 | 2.54 | 230 |
| 1080 | 740 | 1.74 | 1.22 | 1.67 | 1.54 | 210 |

Changes in the slot length S and G are obtained by varying the length of the axial leg. Thus the ratio of slot length S/G may vary between 1.46 and 1.36.

TABLE 2

| FIGS. 2, 3B and 4B | | | | | | |
|---|---|---|---|---|---|---|
| S | G | VSWR 2.40 GHz | VSWR 2.45 GHz | VSWR 2.50 GHz | VSWR Average | BW VSWR = 2.5 |
| 975 | 640 | 1.86 | 1.39 | 1.64 | 1.63 | 175 |
| 985 | 640 | 1.68 | 1.49 | 2.28 | 1.82 | 175 |
| 995 | 640 | 1.64 | 1.85 | 3.15 | 2.21 | 175 |
| 1005 | 640 | 1.45 | 2.18 | 4.17 | 2.60 | 175 |
| 1015 | 640 | 1.57 | 2.74 | 6.21 | 3.51 | 200 |
| 995 | 620 | 1.38 | 1.85 | 3.47 | 2.23 | 190 |
| 995 | 630 | 1.39 | 1.64 | 3.14 | 2.06 | 175 |
| 995 | 640 | 1.64 | 1.85 | 3.15 | 2.21 | 175 |
| 995 | 650 | 1.24 | 1.51 | 2.88 | 1.88 | 200 |
| 995 | 660 | 1.44 | 1.52 | 2.65 | 1.87 | 175 |
| 985 | 649 | 1.38 | 1.07 | 1.64 | 1.36 | 210 |

Changes in the slot length S is obtained by varying the length of the leg 122*c* and the length G by varying the axial leg. The ratio S/G may vary between 1.51 and 1,60.

TABLE 3

| FIGS. 2, 3C and 4C | | | | | | |
|---|---|---|---|---|---|---|
| S | G | VSWR 2.40 GHz | VSWR 2.45 GHz | VSWR 2.50 GHz | VSWR Average | BW VSWR = 2.5 |
| 2200 | 740 | 1.46 | 1.18 | 1.9 | 1.51 | 260 |
| 2210 | 740 | 1.42 | 1.12 | 1.79 | 1.44 | 270 |
| 2220 | 740 | 1.44 | 1.18 | 1.97 | 1.53 | 260 |
| 2230 | 740 | 1.64 | 1.13 | 1.71 | 1.49 | 280 |
| 2240 | 740 | 1.54 | 1.17 | 1.89 | 1.53 | 270 |
| 2220 | 720 | 1.47 | 1.14 | 1.81 | 1.47 | 280 |
| 2220 | 730 | 1.46 | 1.12 | 1.79 | 1.46 | 270 |
| 2220 | 740 | 1.64 | 1.85 | 3.15 | 2.21 | 260 |
| 2220 | 750 | 1.41 | 1.18 | 1.94 | 1.51 | 255 |
| 2220 | 760 | 1.4 | 1.11 | 1.84 | 1.45 | 260 |
| 2230 | 740 | 1.64 | 1.13 | 1.71 | 1.49 | 280 |

Variation of the length S is obtained by varying the length of the transverse legs 122*e* by equal amounts. For the slot length G, the horizontal leg 132*c* is varied. The ratio S/G provides values in the range 3.0 to 3.04.

The preceding values are given as way of example for an application having a center frequency of 2.45 GHz and band edges of 2.40 GHz and 2.50 GHz which represent the ISM standard such as used, for example, by Bluetooth based applications. Antennas 100, as described by FIGS. 2, 3A, 4A, FIGS. 2, 3B, 4B and FIGS. 2, 3C, 4C, operating in other frequency ranges may be produced as well by varying the length of the source slot 122 and/or the ground slot 132 until the desired VSWR and bandwidth values are attained.

The invention claimed is:

1. An antenna comprising a substrate having a pair of oppositely directed surfaces, a source plane conductor on one of said surfaces having a signal line connected thereto, a ground plane conductor on another of said surfaces, each of said conductors having a slot extending therethrough with said slots sized and positioned relative to one another to inhibit the intensity of radiation emanating from said ground plane wherein said source plane conductor is electrically isolated from said ground plane conductor.

2. An antenna according to claim 1 wherein each of said slots extend from a peripheral edge of said substrate.

3. An antenna according to claim 2 wherein one of said slots is L shaped.

4. An antenna according to claim 3 wherein both of said slots is L shaped.

5. An antenna according to claim 2 wherein each of said slots has an axial leg extending on a longitudinal axis of said antenna and a transverse leg extending from said peripheral edge to intersect said axial leg.

6. An antenna according to claim 5 wherein said axial legs are aligned on each of said planes.

7. An antenna according to claim 5 wherein said transverse legs are aligned on each of said planes.

8. An antenna according to claim 3 wherein one of said slots is formed as an H with an intermediate leg extending to a peripheral edge.

9. An antenna according to claim 1 wherein the length of the slot in the source plane is between 1.46 and 1.36 that of the slot in the ground plane.

10. An antenna according to claim 1 wherein the length of the slot in the source plane is between 1.60 and 1.51 that of the slot in the ground plane.

11. An antenna according to claim 1 wherein the length of the slot in the source plane is between 3.0 and 3.04 that of the slot in the ground plane.

* * * * *

UNITED STATES PATENT AND TRADEMARK OFFICE

CERTIFICATE OF CORRECTION

PATENT NO. : 7,050,009 B2
APPLICATION NO. : 10/895899
DATED : May 23, 2006
INVENTOR(S) : Chirila It is certified that error appears in the above-identified patent and that said Letters Patent is hereby corrected as shown below:

In Column 1, Line 28, delete "(RF)" and insert -- (RFs) --, therefor.

In Column 2, Line 21, delete "scanner," and insert -- scanner. --, therefor.

In Column 3, Lines 49-62, delete "In a further embodiment ..... 1960×688 mill." and insert the same at Line 50 as a new paragraph.

In Column 3, Line 52, delete "a intermediate" and insert -- an intermediate --, therefor.

In Column 5, Line 17, delete "1.46 and 1.36." and insert -- 1.36 and 1.46. --, therefor.

In Column 5, Line 37, delete "1,60." and insert -- 1.60. --, therefor.

In Column 6, Line 46, in Claim 9, delete "1.46 and 1.36" and insert -- 1.36 and 1.46 --, therefor.

In Column 6, Line 50, in Claim 10, delete "1.60 and 1.51" and insert -- 1.51 and 1.60 --, therefor.

Signed and Sealed this
Nineteenth Day of March, 2013

Teresa Stanek Rea

Teresa Stanek Rea
*Acting Director of the United States Patent and Trademark Office*